United States Patent [19]

Schenck

[11] Patent Number: 4,724,827

[45] **Date of Patent: * Feb. 16, 1988**

[54] DYNAMIC TRACTION DEVICE

[76] Inventor: Robert R. Schenck, 1100 N. Lake Shore Dr., Chicago, Ill. 60611

[ * ] Notice: The portion of the term of this patent subsequent to Aug. 26, 2003 has been disclaimed.

[21] Appl. No.: 725,130

[22] Filed: Apr. 19, 1985

Related U.S. Application Data

[63] Continuation-in-part of Ser. No. 690,461, Jan. 10, 1985, Pat. No. 4,607,625.

[51] Int. Cl.[4] ..... A61H 1/02

[52] U.S. Cl. ..... 128/26; 128/77; 128/84 C

[58] Field of Search ..... 128/25 R, 25 B, 26, 128/75, 77, 84 R, 84 C, 87, 92 A, 68, 64; 272/67

[56] References Cited

U.S. PATENT DOCUMENTS

| | | | |
|---|---|---|---|
| 2,353,129 | 7/1944 | DeMona | 128/26 |
| 3,020,908 | 2/1962 | Daniels et al. | 128/26 |
| 3,457,912 | 7/1969 | Clark et al. | 128/26 |
| 3,631,542 | 1/1972 | Potter | 128/26 X |
| 3,714,940 | 2/1973 | Palmer | 128/77 |
| 3,756,222 | 9/1973 | Ketchum | 128/26 |
| 3,769,970 | 11/1973 | Swanson | 128/77 |
| 3,961,854 | 6/1976 | Jaquet | 403/59 |
| 4,323,060 | 4/1982 | Pecheux | 128/84 R |
| 4,368,728 | 1/1983 | Pasbrig | 128/26 |
| 4,576,148 | 3/1986 | Koerner et al. | 128/26 |
| 4,624,249 | 11/1986 | Cambras | 128/92 R |
| 4,644,938 | 2/1987 | Yates et al. | 128/26 |

FOREIGN PATENT DOCUMENTS 296618 2/1917 Fed. Rep. of Germany .

*Primary Examiner*—Richard J. Apley
*Assistant Examiner*—J. Welsh
*Attorney, Agent, or Firm*—Fitch, Even, Tabin & Flannery

[57] ABSTRACT

A device is provided for tractioning and flexing an injured or diseased area to expedite the healing of bone or soft tissue fractures or other tissues in a patient. For example, an appendage having a fractured bone is placed in traction and at the same time continuously flexed and extended as is a particular joint proximally connected to the fractured bone in order to prevent joint tissue deterioration. The portable finger dynamic traction device includes a support structure which is attachable to the body to substantially immobilize joints of the body proximal to the particular joint as is necessary to promote flexing of the proximal joint. Associated with the support structure is an actuator reciprocably movable in a substantially arcuate path which is substantially in the plane of the natural bending movement of the particular joint, distally outward of the fracture and with the particular joint substantially at the radial center. A tension member traction the broken appendage to the movable actuator so that the appendage follows the reciprocating movement of the actuator to flex the joint.

12 Claims, 10 Drawing Figures

DYNAMIC TRACTION DEVICE

This is a continuation-in-part of U.S. patent application Ser. No. 690,461, filed Jan. 10, 1985 now U.S. Pat. No. 4,607,625.

BACKGROUND OF THE INVENTION

The present invention relates to devices for expediting the healing of bone or soft tissue fractures or other defects in a patient, and more particularly to devices for applying traction and at the same time flexing the joint or joints adjacent the injured area.

It has long been known to place fractures, particularly comminuted fractures, under distal traction. Otherwise, compressive forces exerted on the healing bone will tend to collapse the bone. Patients with fractured leg or arm bones may lie in bed with their broken limbs tractioned to devices at the ends of their beds. For healing comminuted finger bones (phalanges), portable devices are in use which are attached to the arm and which hold the finger immobilized under distal traction.

One noted consequence of bone fracture and the subsequent healing process is stiffness of joints and deterioration of cartilage tissue in the joints to which the fractured bone is connected, particularly the joint immediately proximal to the fractured bone. There is good medical evidence to suggest that the cartilage deterioration is, to a significant degree, a result of extended immobilization of the joints.

A number of recent studies relating to joint disorders suggest the value of subjecting injured or diseased joints to passive motion, which preferably is continuous. For example, Robert Salter et al., "The Biologic Effect of Continuous Passive Motion on the Healing of Full Thickness Defects in Articular Cartilage", *Journal of Bone and Joint Surgery*, 62-A:1232-1251, 1980, describes the beneficial effects of continuous passive motion on healing of cartilage defects with apparently normal hyaline and cartilage. Richard H. Gelberman, et al., *The Journal of Bone and Joint Surgery*, 65A, pp. 70-80 (1983) describe the benefits of controlled motion in flexor tendon healing and restoration. As a result of such studies, various devices have been proposed to provide passive motion to damaged or diseased joints. Recently, devices have become available for continuously flexing and extending phalangeal joints for joint healing and joint therapy. One example of such a device is sold by Sutter Biomedical, Inc. Another such device is sold by Toronto Medical Corp. under the tradename "Mobilimb". Although both of these devices have advantages for joint therapy and promote healing of damaged or diseased joints, they do not place the phalanges under traction in the manner desired for healing fractures and are generally unsuitable for the treatment of unstable phalangeal fractures. The Toronto Medical Corp. specifically notes in its product information literature that its unit is contraindicated for unstable fractures.

Devices which apply traction to or adjacent the joint are often connected in a manner which does not permit application of substantial traction force to the joint. For example, an attachment glued to a fingernail may pull out the fingernail when highly tractioned. Other attachments to fingers, or the like, pull off or do not apply the traction force sufficiently directly to the joint.

It is a primary object of the present invention to provide motion to joints that are proximally adjacent to fractures, and at the same time, to apply traction to the fractured bone or soft tissue while the joint is in motion.

SUMMARY OF THE INVENTION

The invention provides apparatuses or devices for holding a fractured bone under distal traction to prevent its collapse during healing while at the same time passively moving the joint or joints to which the fractured bone is attached between a flexed and an extended position. A device according to the invention includes a support member (or means for rigidly attaching the device to a support member) that positions the device relative to the body and immobilizes, as necessary, joints proximally located relative to the fracture. For example, a device for healing a broken finger bone (phalange) includes a cast-like support member that immobilizes the wrist joint and any additional joints of the hand and fingers, as required. Positioned relative to the support member is an actuator which travels in an arcuate locus or path that is distally outward of the broken bone, e.g., distal of the tip of a broken finger, in the plane of natural extension and flexing of a selected joint proximal to the fractured bone (generally the joint immediately proximal to the fractured bone) and with the proximal joint generally at the radial center. Traction means, such as elastomeric bands or springs, are connectable between the appendage and the reciprocating actuator for continuously tractioning the bone and causing the appendage to bend at the selected joint.

The invention further provides for the use of apparatuses, as described above, for the treatment of a broken bone. The support means is proximally attached to the body to immobilize joints of the body proximally located relative to the fracture as is necessary to promote bending at the joint selected for passive bending, and the actuator is positioned relative to the support means for movement in an arcuate path that is in the plane of natural appendage bending at the selected joint and with the selected joint substantially at the radial center of the arcuate path. At a location distal to the fracture, the appendage is tractioned to the actuator, and the actuator is reciprocated along its arcuate path to passively bend the tractioned appendage. The continuous traction prevents collapse of the fractured bone as it heals, while the passive motion prevents or minimizes cartilage deterioration during healing.

These and other objects and advantages of the invention will be described in greater detail with reference to the accompanying drawings of which:

DESCRIPTION OF THE PREFERRED EMBODIMENTS

The present invention provides a device 10 for expediting the healing of an injured or diseased area, such as a soft tissue or bone fracture. The invention is illustrated and described in connection with an embodiment used with a fracture, such as a fractured phalange 12 or an interphalange fracture, which is to be held under dynamic traction while being flexed. That is, the device 10 holds the bone 12 under distal tension or traction, while at the same time, the device passively bends a joint 15 or joints, to which the bone is connected, in a generally normal manner between a flexed and an extended position during at least one phase of bone healing. The passive motion, which preferably is continuous during the healing phase, protects the joint against cartilage deterioration, for example, that which is known to frequently accompany healing of phalangeal intraarticular fractures. Also, for comminuted or intra-articular fractures, the tension forces may relieve compressive forces holding bone fragments apart and thereby cause or allow the tendons and ligaments to help reposition the bone fragments back into their anatomical position.

The invention is described herein primarily with respect to dynamic traction devices tailored for broken bones, and more specifically phalanges. However, the devices described herein can be modified to provide similar dynamic traction to other injured or diseased areas, such as soft tissue fractures or to cartilage tissue at a joint, as well as other bones in other broken appendages. For example, broken arms and legs may be dynamically tractioned so as to provide passive motion to knee, hip, ankle, wrist, elbow or shoulder joints. Particular attention is paid in this application to devices for dynamically tractioning finger bones, particularly to devices designed to be portable, whereby the patient may carry on in a generally normal manner. To provide similar dynamic traction for a larger fractured bone and the immediately proximal joint, the patient in most cases is generally confined to a bed or chair and a modification of devices, such as described herein, where portability is not of particular concern, requires only obvious design modifications.

Figure 2:
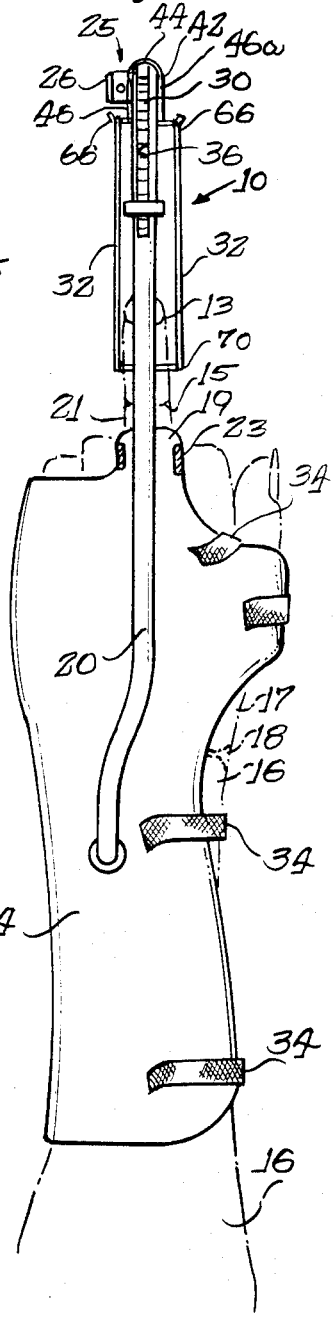
FIG. 2 is a view of the device of FIG. 1 as viewed from the back side of the hand.
Figure 3:
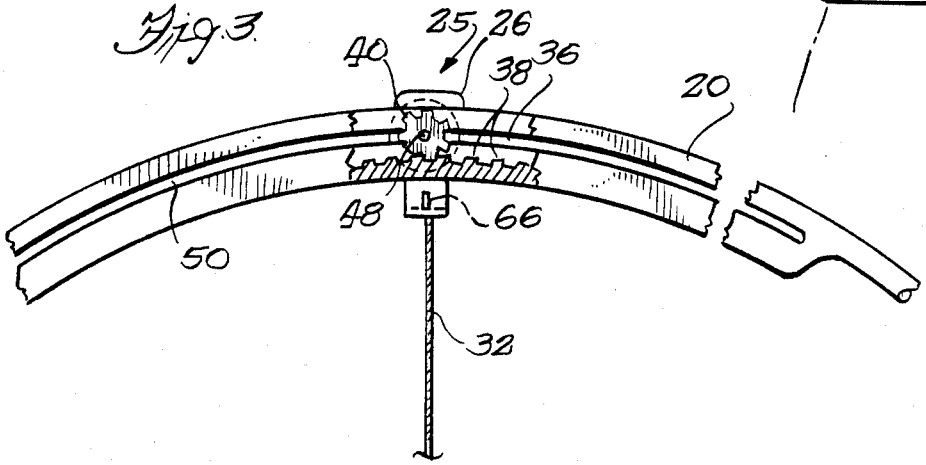
FIG. 3 is an enlarged side view, partially cut away, of a portion of the ring member or frame of the device and the locomotion device or carriage that moves therealong.

In embodiments of the invention particular to devices for fractured phalanges, the invention provides a wearable portable device 10 which is worn on the hand 17 and forearm 16 of the patient for holding the finger 13 with the fractured bone 12 under dynamic tension during healing. The device 10 includes a support means, such as splint or half-cast 14, which is securable to the forearm 16 and hand 17 for holding the wrist joint 18 substantially stationary relative to the forearm and immobilizing other joints of the hand 17, particularly hand and finger joints proximal to the fractured bone. Immovably connected to the cast 14 is a frame or ring 20 which is positioned by the cast in surrounding relationship to the broken finger 13 to define an arcuate path or locus that is generally in the plane of natural bending of the broken finger, substantially outward of the finger tip, and with the joint 15, to which the fractured bone 12 is immediately proximally connected, generally at its radial center. An actuator means for moving the tractioned finger comprises, in this embodiment of the invention, a carriage 25 which is movable along a track 30 that extends along an arcuate portion of the ring 20. The actuator means includes a driving means 26 (FIG. 2), such as an electric motor, spring motor, etc., which moves the carriage 25 along the track 30, and means 28, 52 associated with the motor and/or the track for reversing the direction of the carriage to provide for continuous reciprocation of the carriage along the track. Means, such as an elastomeric band or bands 32, are secured between the broken finger 13, at a location distal to the fracture, and the actuator means for holding the finger to the latter under traction and also for pulling the finger along so that it follows the reciprocating arcuate travel of the actuator means.

The illustrated means of securing the device 10 to the hand 17 and forearm 16 is a conventional type of half-cast 14 which holds the wrist joint 18 substantially immobile, keeping the hand linear relative to the forearm and also immobilizing various hand and finger joints, as required. Half-casts are pre-formed of a polymeric material in a variety of sizes for fitting a variety of hand and arm sizes. The illustrated half-cast 14 is held to the forearm and hand by fabric loop fasteners 34, such as those sold under the tradename "Velcro"; however, other fastening means, such as straps, might be used as well. The pre-formed half-cast has the advantage of being relatively lightweight and provides aeration of the skin of the arm, preventing sores from developing. Furthermore, the half-cast gives some freedom of movement to the portions of the hand, such as the thumb (if this is not the fractured digit) during healing. In circumstances where greater stability is required, a more rigid, entirely encircling cast might be used instead. For example, the frame 20 may be pre-attached to a support plate or the like which is then wrapped in plaster-impregnated cloth to form a conventional hard-set cast that supports the ring-shaped frame.

The device 10, illustrated with respect to FIGS. 1–6, presumes a fracture of the middle phalange 12 of the middle finger 13 and that it is the proximal interphalangeal joint 15 which, in this case, is most subject to stiffness and deterioration and therefore most needs continuous passive motion to prevent or minimize cartilage deterioration. In the particular device, a support protrusion 19 of the cast extends behind the proximal phalange 21 of the middle digit 13 for splinting the same, and a fabric loop fastener 23, which is secured to the support protrusion 19, extends around the proximal phalange 21 to immobilize the same while leaving the proximal interphalangeal joint 15 free to bend. The connection to the finger is distal to the fracture and to the joint which is desired to be flexed. The protrusion 19 which splints the proximal phalange may be angled from the rest of the cast to hold the metacarpal-phalangeal (knuckle) joint somewhat bent, e.g., up to an angle of about 70°. The cast 14 and frame 20 are constructed so that the frame is in the plane of natural bending of the middle finger 13 and with the proximal interphalangeal joint 15 of this digit generally at the radial center of the ring-shaped frame. Relatively minor modifications of the cast to dynamically traction other digits or to provide for bending of other interphalangeal or metacarpal-phalangeal joints according to the anatomy of the patient are considered to be within the scope of the invention.

The frame or ring 20 extends from the splint or half-cast 14 just above the wrist joint 18 from the front side of the forearm 16 to the rear side. The ring, like the half-cast, may be constructed from a polymeric material with sufficient rigidity and structural strength, such as Ray-Splint isoprene or orthoplast splinting material sold by Johnson and Johnson Co. of New Brunswick, N.J., U.S.A. In the illustrated device 10, the half-cast 14 and ring 20 are molded as an integral unit.

A variety of devices may be used for moving and tensioning the phalange, and although the devices which are hereinafter described are intended to represent best modes currently known to the inventor, it is not intended that the invention be limited to the specific embodiments which are herein described and illustrated.

Figure 1:
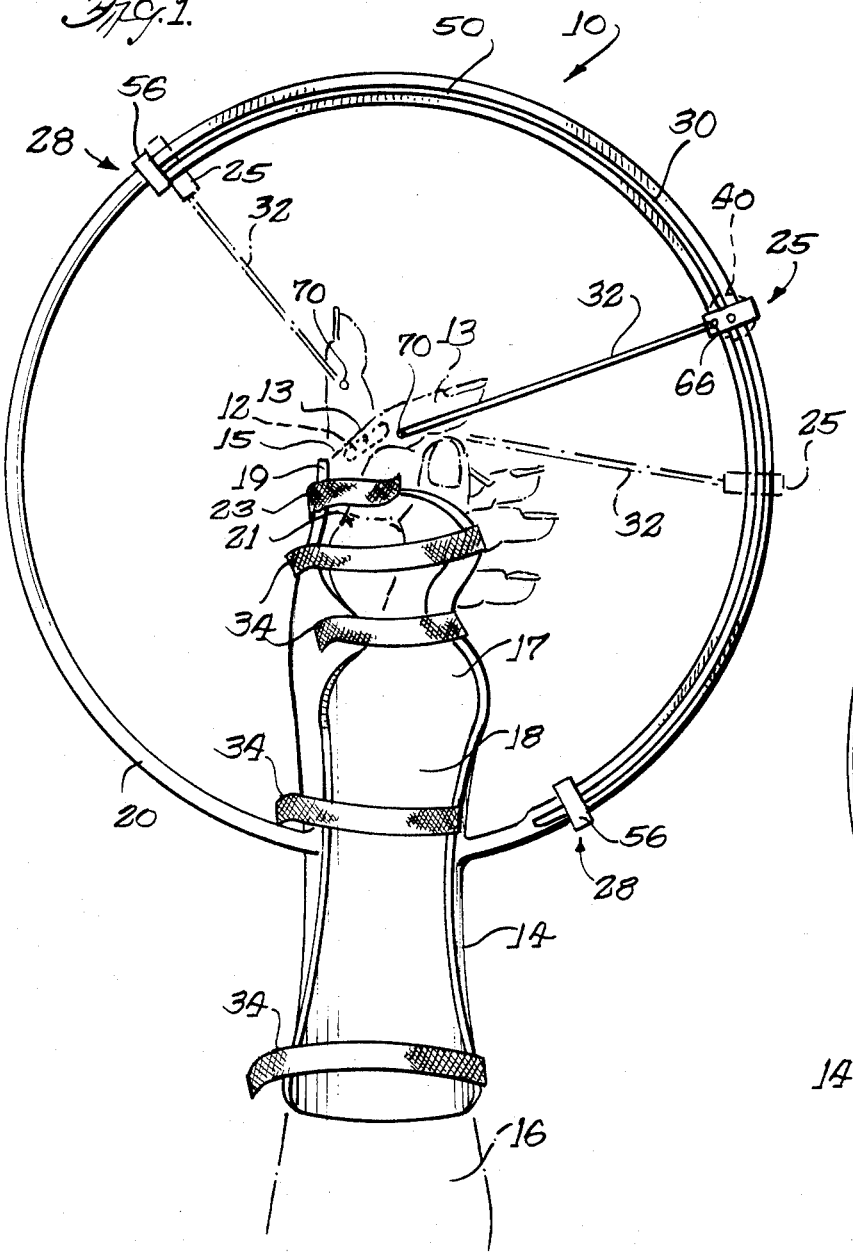
FIG. 1 is a side view of a device, embodying various features of the invention, affixed to the forearm and hand of a patient and holding a fractured digit under dynamic tension.
Figure 4:
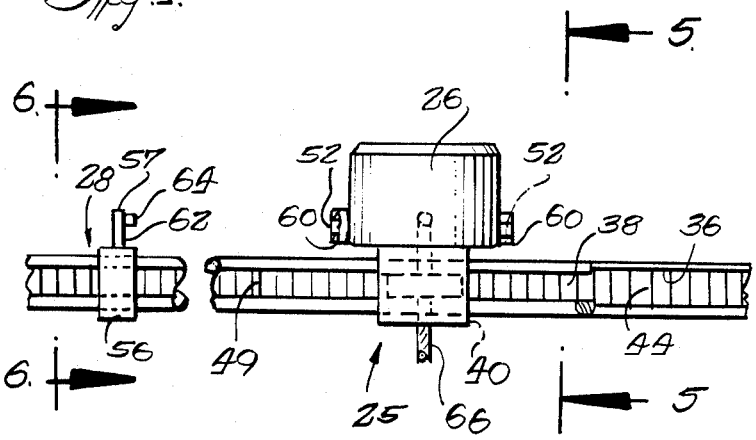
FIG. 4 is a plan view of the portion of the frame and carriage shown in FIG. 3.
Figure 5:
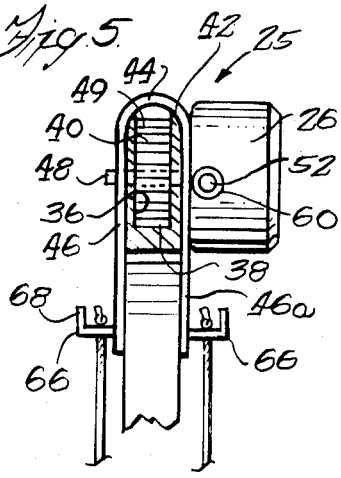
FIG. 5 is a view taken along line 5—5 of FIG. 4.
Figure 6:
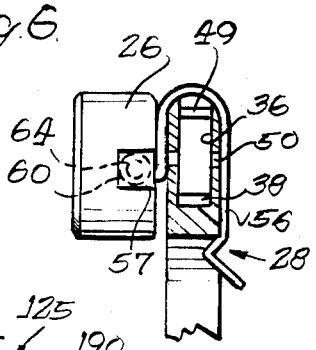
FIG. 6 is a view taken along FIG. 6—6 of FIG. 4.

In the embodiment illustrated with respect to FIG. 1, the track 30 includes a groove 36 opening to the outside of the ring 20 and a row of teeth or cogs 38 at the bottom of the groove, as best seen in FIGS. 4 and 5. A cog wheel 40 of the carriage is received within the groove 36 and meshes with the cogs 38 of the track 30 as it is driven therealong. The cog wheel carriage movement provides for precise movement along the track without slippage.

The body of the carriage is a bracket 42 (FIG. 5) having a U-shaped end 44 which fits around the outside of the ring 20 and legs 46 which extend radially inward along the sides of the ring. The cog wheel 40 is mounted from the bracket 42 by its axle 48 which extends through openings in the legs 46 of the carriage bracket 42. Inward of the bracket legs 46, the axle 48 also extends through arcuate slits 50 (FIGS. 1 and 3) in the sidewall of the ring 20 along the track 30 portion. The carriage 25 is radially positioned in the track 30 by the interaction of its axle 48 and the arcuate slits 50, which are just slightly wider, in a radial direction, than the diameter of the axle. Also mounted from one leg **46*a* of the bracket 42 is the drive means or motor 26 which directly drives the axle 48. The axle 48 is rotationally fixed to the cog wheel 40 and transmits the power of the motor to the cog wheel. Dowels 49 (FIGS. 4–6) interconnect the lateral sides of the frame 20 radially outward of the slits 50** at a plurality of arcuate locations for stabilizing the frame sides.

The carriage 25 is intended to move very slowly, a reciprocal cycle in the range of between about ten minutes to about sixty minutes, or even to every four hours, being contemplated, and accordingly, the motor 26 that drives the carriage 25 may be very low power. Low power electrical motors are commercially available that are suitable for driving the carriage 25 and which carry self-contained electrical cells. The embodiment of the invention illustrated in FIGS. 1–6 requires either a reversible motor or a linkage between the motor and the axle that is shiftable to change the direction of carriage movement at the ends of the track.

As a means of defining the limits of carriage travel at the ends of the track 30 and for reversing the direction of the carriage 25 at the ends of the track, associated with the motor are limit switch means 52 and associated with the track 30 are limit or stop means 28 for actuating the limit switch means. The limit switch means associated with the illustrated motor 26 are illustrated by direction buttons 52 at the front and rear of the motor. The buttons 52 are actuated to change the direction of the carriage 25 when either abuts a stationary object, i.e., the stop means 28. The buttons 52 may activate electronic circuitry, associated with an electrical motor, which reverse the direction or power delivery of the motor. Alternatively, the buttons 52 may mechanically act upon a motor-axle linkage (not shown) to shift the linkage between a forward and reverse position.

The stop means 28 associated with the tracks 30 are a pair of clips 56 (FIGS. 4 and 6), each carrying a stop 57 positioned for contacting the respective direction-changing button 52 at the limits of carriage travel. The illustrated clips 56 are formed of spring metal and are configured so as to grip the ring 20 tightly to define the end positions of carriage travel. The illustrated clips 56 may be relocated along the track 30 by the physician to adjust the limits of carriage travel. A cylindrical shield 60 extends from the motor 26 around each direction button 52 to protect against accidental activation of the button. The stop 57 carried by each stop means bracket 56 consists of a plate 62 from which extends a boss 64 (FIG. 4) or protrusion that is positioned to abut the end of the respective button 52 and proportioned to fit into the shield 60 and depress the button. Thus the carriage 25 is driven continuously, first in a counterclockwise direction to extend the finger until one direction button 52 contacts the stop boss 64 and is switched thereby, and then in the other (clockwise) direction to flex the finger until the other direction button 52 contacts the other end stop boss, again reversing the direction.

As a means of connecting the elastomeric bands 32 that traction the finger to the carriage 25, the carriage bracket 42 carries a pair of pins 66, one extending from each bracket leg 46, the ends 68 (FIG. 5) of the pins being bent radially outwardly so as to prevent the elastomeric bands from slipping from the ends of the pins. The pin is able to transmit higher force loads to the finger than may be transmitted to the finger nail to which may be glued a hook for connection to an elastomeric band. Heretofore, devices attached to the appendage, either by adhesive or a strap, did not apply sufficient traction force to the joint being healed. Or, the attachment devices did not apply force in distal direction as is usually desired. On the other hand, the pins in the joint can apply very substantial traction forces to the joint without pulling out.

As a means of connecting the elastomeric bands to the digit itself, a pin 70 is implanted through the finger 13 distal to the fracture in a surgical procedure in which a hole is drilled through the bone and the pin inserted. The surgically inserted pin 70 extends from both sides of the finger, providing for attachment of an elastomeric band 32 along each side of the finger 13 to the corresponding pin 66 which extends from the legs 46 of the carriage bracket 42. The pin 70 may be inserted through the fractured bone itself, distal to the fracture, as shown, or may be inserted through the bone that is immediately distal to the fractured bone. Pin placement depends on factors to be determined by the physician, such as the type and location of fracture. As an alternative, an opening might be drilled through a fingernail and a pin extended therethrough for connection to the band or bands. However, having a band extend along both sides of the finger, as illustrated, helps to stabilize the digit in the plane of its flexing.

The amount of the tension placed upon the finger 13 is determined by the nature and degree of stretching of the elastomeric bands 32. Essentially, the bands are like ordinary rubber bands; however, they are preferably formed of a more stable material, which will not wear out and snap when worn by the patient. Alternatively, the finger might be tractioned to the carriage 25 by means of a coil spring.

Because the proximal phalangeal joint 15 is approximately at the center of the locus of carriage travel, a substantially uniform traction tension is maintained on the middle phalange at all times. As the carriage 25 travels, the finger 13 generally follows the carriage so as to flex and extend. To insure a full range of movement, the carriage 25 preferably moves along the track 30 a small distance beyond that which would be necessary to fully extend and flex the joint 15 if the finger were more rigidly connected thereto. By providing an extended range of carriage movement relative to the finger which is connected thereto by the elastomeric bands 32, the muscles and connective tissues extend or flex to their extreme positions. The finger 13 resists movement in the direction of the pulling force exerted by the carriage 25 through the bands 32 beyond its natural range of flexing and extension.

The device 10 provides for passive motion of a finger 13 during healing as the patient engages in normal activities and even as the patient sleeps. At the same time, the finger is held under a predetermined traction to prevent collapse of the fractured bone.

Figure 7:
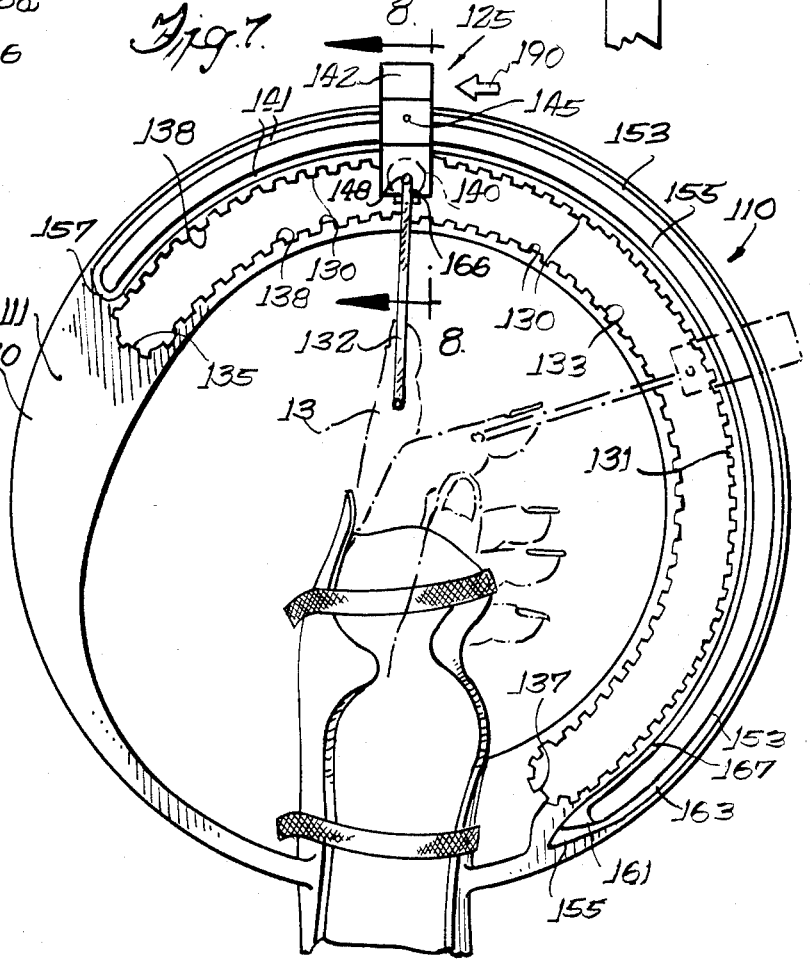
FIG. 7 is a side view of an alternative embodiment of the invention.
Figure 8:
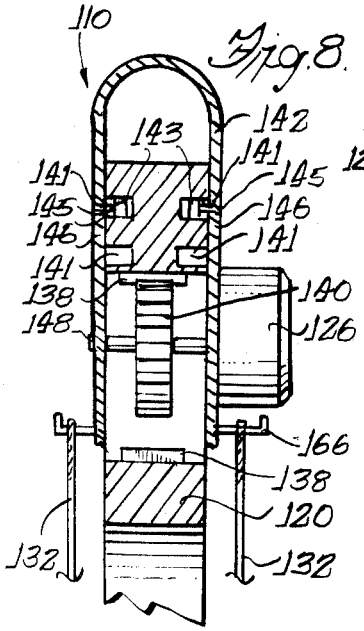
FIG. 8 is a view taken along line 8—8 of FIG. 6.

Illustrated in FIGS. 7 and 8 is an alternative embodiment of a device 110 according to the invention in which the limits of carriage 125 movement is determined by the track 130 itself which runs in a continuous loop, thereby requiring no reversal of direction of the driving means 126 and no separate limit means for changing carriage direction. In this embodiment, a continuous loop cogged track 130 is formed in a radially thickened portion 111 of the frame or ring 120. The track 130 is generally arcuate, including an arcuate outer cogged track segment 131 and an inner arcuate cogged track segment 133 as well as interconnecting cogged end track segments 135, 137. As in the embodiment described in reference to FIGS. 1–6, the movable carriage 125 includes a cog wheel 140 (FIG. 8) which meshes with teeth 138 of the track, a bracket 142 which fits around the outside of the frame ring 120, the cog wheel axle 148 which is mounted for rotation from the bracket 142, a bracket-mounted motor 126 (FIG. 8) which continuously and directly drives the cog wheel axle, and pins 166 extending from legs 146 of the bracket by which the elastomeric bands 132 are mounted.

As a means to keep the cog wheel 140 radially aligned and meshed with the track 130, guide means are provided for helping to define the radial position of the carriage 25, first as it moves along the outer segment 131 of the track 130 in one direction and then as it returns in the other direction along the inner segment 133 of the track. The guide means include continuous loop guide slots 141 along the sides of the ring 120 which correspond to the locus of movement of the cog wheel 140 along the track 130 and opposed guide rollers 143 (FIG. 8) rotatably mounted from pins 145 extending inwardly from the bracket 142 a predetermined radial distance from the cog wheel axle 148 for tracking along the guide slots. The guide slots 141 each include an outer segment 153 (FIG. 7) in which the respective guide roller 143 tracks as the cog wheel 140 meshes with the outer track segment 131, an inner segment 155 in which the guide roller 133 tracks as the cog wheel meshes with the inner track segment 133 and curved end segments 155, 157 in which the guide roller tracks as the cog wheel 140 meshes with the curved end segments 135, 137 of the track.

With reference to FIG. 7, the motor 126 drives the carriage 125 in the direction of the arrow 190 in a first (counterclockwise), finger-extending direction. At the left-hand end of the track 130, the cog wheel 140 moves inwardly along the end segment 135 of the track as the guide rollers 143 move inwardly along the corresponding end segment 157 of the guide slot 141. Then, with the motor 126 driving the cog wheel 140 in the same rotational direction, the carriage 125 moves in the second (clockwise) direction for flexing the digit.

At the left hand end of the track where the carriage moves radially inward, the tension of the bands 132 between the digit 13 and the carriage cooperates with the locus of carriage 125 travel defined by the track 130 and guide slots 141. At the right-hand end of the track; however, where the carriage 125 moves along the other end segment 137 from the inner track segment 133 to the outer track segment 131, the carriage 125 is moving radially outward in opposition to the tension of the elastomeric bands 132. To help asure that the guide rollers 143 relocate from the inner slot segments 155 to the outer slot segments 153, a piece of spring metal 161 is placed at the right-hand end of each guide slot so as to serve as a one-way gate. The spring metal gate 161 is attached at one end to the inner surface 163 of the outer slot segment 153 with its free end extending to the inner surface 167 of the inner guide slot segment 155. As the rollers 143 track along the inner guide slot segments 155, they flip the spring metal gates 161 out of the way; however, once the rollers 143 have cleared the spring metal gates, the gates snap back, and with the free ends of the gates abutting the inner surfaces 167 of the inner slot segments 155, the gates help to guide the rollers 143 outward and into the outer guide slot segments 153 for carriage direction reversal.

This embodiment requires only that the drive means or motor 126 provide power in one direction. This may be advantageous if a mechanical drive means, such as a spring-wound motor, is used as the drive means. Although there is less tension exerted on the digit as the cog wheel 140 tracks along the inner track segment 133 than when it tracks along the outer track segment 131, the slight difference in traction is considered to be insignificant.

Figure 9:
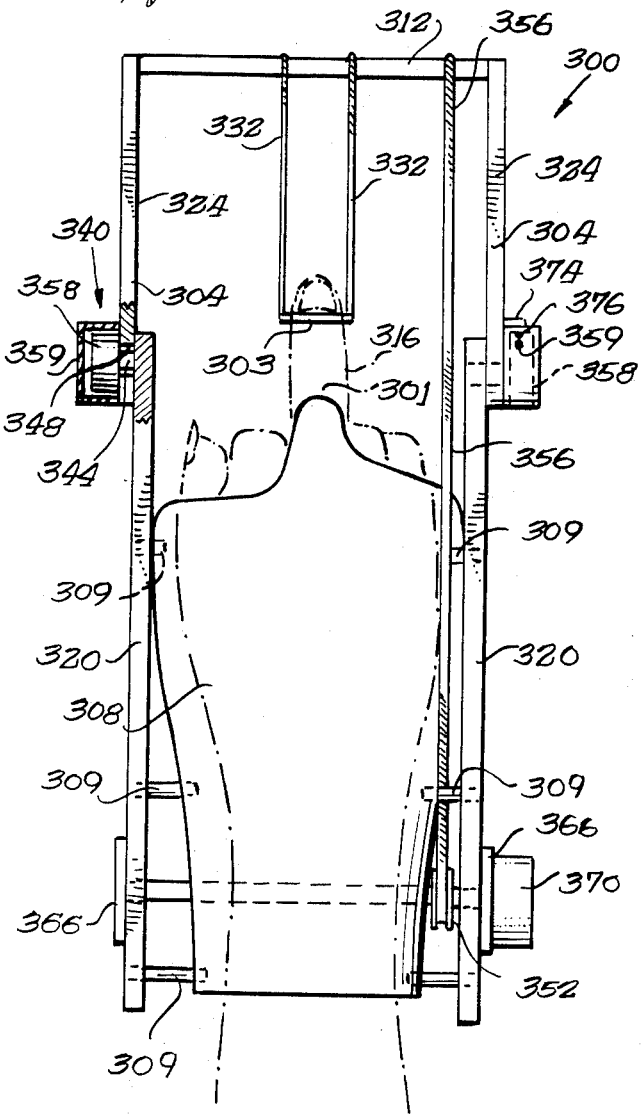
FIG. 9 is a rear view of a still further embodiment of the present invention.
Figure 10:
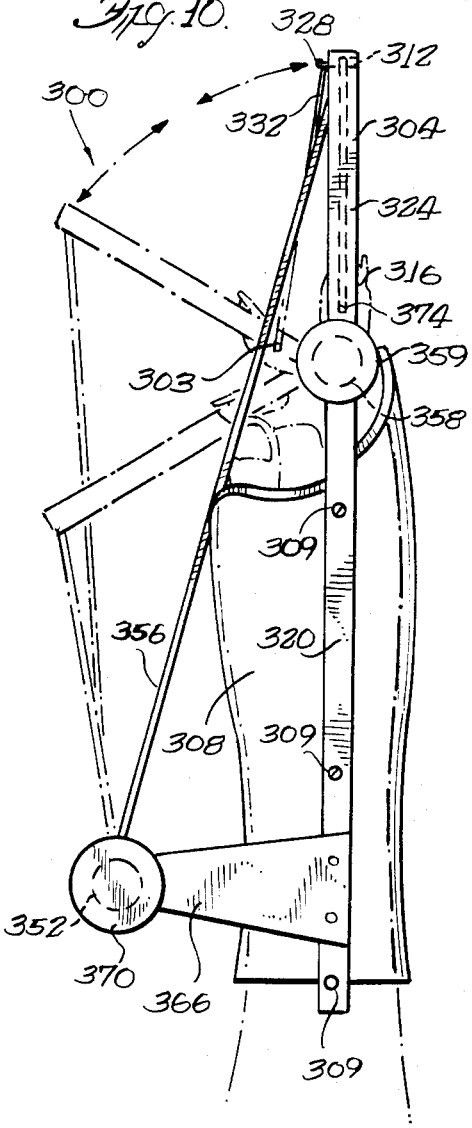
FIG. 10 is a side view thereof.

Illustrated in FIGS. 9 and 10 is an alternative device 300 embodying the invention in which the actuator includes a bail or frame 304 which is pivotably mounted to a cast 308. The pivoting bail 304 carries a central portion or rod 312 at its distal end along an arcuate path generally in the plane of finger extension and flexing, outward of the tip of the broken finger and with the joint 301 proximal to the fractured phalange generally at the radial center of the arcuate path. The broken finger 316 is tractioned to the swinging bail rod 312 by an implanted pin 303 and by elastomeric band means 332, and means are provided for driving the pivoting frame 304 first in one direction and then in another direction to continuously flex and extend the broken finger that is held under traction. In this case, the pin 303 is shown implanted through the bone that is immediately distal to the fractured bone.

The bail 304 comprises a pair of parallel bars 320 rigidly mounted, e.g., by bolts 309, to the lateral sides of the cast 308. The bail 304, in this case, consists of a pair of parallel rods 324 which are mounted at their proximal ends for pivoting from the distal ends of the parallel base bars 320. The central rod 312 of the bail extends between the parallel frame rods 324 at their distal ends and which carries hook means 328 for attachment of the elastomeric bands 332 thereto. In the illustrated embodiment, the rod 312 carries a pair of spaced apart hooks 328 (FIG. 10), and a pair of elastomeric bands 332 are attached to opposite sides of the pin 303 that is surgically implanted through the phalange.

The pivot 340 interconnecting the support bars 320 and bail rods 324 each comprise a pin or axle 344 extending laterally from the bars into a matched in diameter opening 348 in the respective rods. The bail rod is reciprocated along the arcuate path to alternately extend and flex the finger by means of a motor-driven reel 352 which winds or unwinds a cord 356 connected to the rod 312 and by a pair of sprial springs 358, associated with the pivots. The illustrated springs 358 are each encased in a protective housing 359.

More particularly, a spiral spring 358 is mounted from each parallel frame rod 324 and is connected to the correspoding pivot pin 344 so as to constantly bias the rods of the frame 304 to pivot in the finger-extending direction (clockwise with respect to FIG. 10). Acting in opposition to the biasing of the springs 358 for limiting movement of the frame 304 in the finger-extending direction is the cord 356 that extends between the central rod 312 and the motor-driven reel 352. The reel 352 is rotationally mounted in front of the forearm 362 by a pair of supports 366 which are attached at the proximal ends of the parallel bars 320. A small, reversible motor 370 is mounted from one of the supports 366 and directly drives the reel 352, first in one direction to coil the cord 356 around the reel, pulling the bail 304 and central rod 312 counterclockwise in opposition to the direction of spring biasing for finger flexing and then in the opposite direction to allow the cord 356 to play out from the reel and allow the bail to pivot in the finger-extending direction in response to the clockwise biasing by the spring. The finger, which is tractioned by the elastomeric bands 332 to the bail rod 312, generally follows the arcuate path of the carriage beam, and thereby is continuously, passively flexed and extended.

As a means of defining the limits of bail 304 and rod 312 movement, one of the frame rods 324 carries a protrusion 374 (FIG. 9) formed of detectable material, and associated with the corresponding spiral spring housing 359 are sensing means 376 for detecting passage of the protrusion 374 during pivoting motion of the frame. The sensing means are electrically connected to electronic switching means, associated with the motor 370, that reverses the direction of the motor after the bail 304 has pivoted to a predetermined limit in each direction. By providing a plurality of sensors 376 arcuately positioned along the spring housing 359, the switching means associated with the motor 370 may be specifically programmed to provide various extents of arcuate motion, according to the needs of the patient.

The significance of the present invention can now be more fully appreciated. For the first time, it is possible to provide continuous traction to a fractured bone and at the same provide the passive motion that helps to assure that the cartilage and other connective tissues are continuously exercised. As substantial traction and passive motion are indicated to be helpful in preventing cartilage deterioration, devices according to the invention should provide more complete and satisfactory healing of injured appendages.

While the invention has been described in terms of certain preferred embodiments, modifications obvious to one with ordinary skill in the art may be made without departing from the scope of the present invention. For example, the carriage may be carried in an arcuate path by a continuous loop belt or chain. With relatively minor modifications, devices according to the invention may be modified to dynamically tension several broken fingers at once.

As noted above, although the invention has been described herein primarily with respect to healing a fractured finger bone, the invention is applicable to tractioning and flexing other portions of the body and the invention is applicable to tractioning other broken appendage bones while at the same time passively bending a joint, particularly a joint that is immediately proximal to the broken bone. For providing dynamic traction for larger bones, such as bones in the arm or leg, it is generally impractical to provide portable apparatuses, and the patient will generally be confined to a bed or a chair while under dynamic traction. Also, although continuous passive motion may be desirable for maintaining or regenerating connective tissue, for the comfort of the patent, the passive motion may have to be provided intermittently, such as at therapy sessions.

As portability is not an important consideration, apparatus for providing dynamic traction to such larger bones and connected joints may be designed with fewer constraints. The support means, in such cases, may be the bed or chair in which the patient is confined. For example, a patient with a fracture may be strapped to a bed or stretcher and also attached to an actuator device which holds his fractured leg under tension while flexing his hip bone. Springs, rather than elastomeric bands may be required to provide sufficient traction. With the constraints of portability removed, the drive motor may be positioned in a variety of orientations, as is convenient, relative to the actuator means which flexes the joint in an arcuate path. Relatively immobile devices for dynamically tractioning larger broken bones and connected joints may be alternately connected to power sources within a hospital or therapy center, such as stationary motors or air or vacuum supplies.

For fractures in larger appendages, as in the case with phalanges, it is generally desirable to have firm transosseous fixation of the appendage to the device at a location distal to the fracture. For example transosseous wires may be placed through the radius for the treatment of elbow intra-articular fractures or through the medial and lateral malleoli area of the ankles for intra-articular fractures of the knee. Alternatively, the means of attaching the hand or foot to the tractioning device may be a glove-like or boot-like device.

Because of the variety of configurations which relatively stationary dynamic traction devices may take, such devices which may be used for treating larger fractured appendages are not described in detail herein. The principles of the invention are fully represented by the dynamic traction devices which are specifically designed for finger therapy. The teachings with respect to the illustrated devices are believed to be sufficient to instruct one with ordinary skill in the art, to manufacture, with obvious modifications as required in view of anatomical and size considerations, to provide apparatus for dynamically tractioning other fractured appendage bones and the joints connected thereto. The advantages of providing passive motion to joints connected to tractioned, fractured bones, generally hold true for a variety of joints, continuous or regular joint motion preventing or minimizing deterioration of cartilage tissue.

Various features of the invention are recited in the following claims.

What is claimed is:

1. Apparatus for tractioning a fractured bone of an appendage and exercising a particular joint proximal thereto comprising:

support means to support a portion of the patients body to allow flexing of said particular joint while immobilizing joints proximal thereto as is necessary to promote flexing primarily at said particular joint, means on said support means providing an arcuate guide path located distally outward of the joint to be flexed, actuator means movable along the arcuate guide path, which arcuate guide is distally outward of the fracture generally in the plane of flexing of said particular joint and having said particular joint generally at the radial center, tension means connected to the appendage for tractioning the appendage, at a location distally outward of the fracture, and connected to said actuator means, and power means for reciprocating said actuator means along said arcuate guide path to simultaneously apply a traction force and a flexing force to the joint.

2. Apparatus according to claim 1 in which said means on said support includes an arcuate track and said actuator means including a carriage means mounted on said track for reciprocal movement therealong.

3. Apparatus according to claim 2 wherein said track has cogs and said carriage has a cog wheel which meshes with said track as said carriage is driven along said track.

4. A method of expediting the healing of bone or soft tissue fractures or defects in a patient by flexing a joint while applying a substantial distal outward traction force to the joint, said method comprising the steps of:

attaching to the patient an attachment adjacent an injured area to be healed, pulling on the attachment with a tension member in an outward direction to exert a substantial distal traction force to relieve compressive forces at the area to be healed, and oscillating the tension member and thereby oscillating the attachment and the attached area of the patient through a predetermined path of movement while simultaneously the substantial outward pulling traction force is being applied thereto by said tension member.

5. A method in accordance with claim 4 including the step of implanting a pin attachment into the patient and applying the pulling force to the pin attachment.

6. A portable body-mounted device for exercising a fractured appendage under traction comprising:

a support attachable to the body of the patient proximal to the fracture and adapted to be carried about by the patient, tension means for attachment to the appendage distal to the fracture and for exerting a traction force on the fracture, drive means, including a drive motor, on said support and connected to said tension means to move the latter and the attached appendage first in one direction then in the other direction to passively bend the appendage to exercise joint tissue as the fracture heals under traction, and wherein said tension means includes a tension band extending from the appendage to said drive means and said drive means is mounted on the support for reciprocating an outer end of the tension band in a predetermined path.

7. A device in accordance with claim 6 in which said drive means mounted on the support includes a bail pivotably mounted on said support and having the outer end of said tension band attached to an outer portion of said bail and said bail being driven by said, motor in a reciprocating swinging movement.

8. A device in accordance with claim 6 in which said drive means mounted on the support includes a carriage connected to the outer end of said tension band, said carriage being driven by said motor in an arcuate path on said support.

9. A method of treating a fractured appendage bone to prevent deterioration of a particular joint proximally connected thereto during bone healing, the method comprising immobilizing joints of the patient proximal to the particular joint as is necessary to promote bending at the particular joint, providing an actuator movable in an arcuate path and aligning said actuator so that said arcuate path is generally coplanar with the plane of natural bending of the particular joint, distally outward of the fracture and having the particular joint generally at the radial center, tractioning the appendage at a point distal to the fracture to said actuator and pulling distally outwardly of the fracture, and moving the actuator along said arcuate path to passively bend the appendage while simultaneously pulling distally outwardly on the bending appendage, which passsive motion and simultaneously applied outward traction helps to prevent joint tissue deterioration during bone healing.

10. A method of treatment according to claim 9 wherein a pin is implanted through the fractured appendage and said appendage is tractioned to said actuator by connection to said pin.

11. A method of treatment according to claim 10 wherein said pin is implanted extending through a distal end of the fractured bone.

12. A method of treatment according to claim 11 wherein said pin is implanted extending through a bone distal to the fractured bone.

* * * * *

UNITED STATES PATENT AND TRADEMARK OFFICE

CERTIFICATE OF CORRECTION

PATENT NO. : 4,724,827

DATED : February 16, 1988

INVENTOR(S) : Robert R. Schenck

It is certified that error appears in the above-identified patent and that said Letters Patent is hereby corrected as shown below:

Column 3, Line 22, Change "intraarticular" to --intra-articular--

Column 6, Line 33, Change "finger nail" to --fingernail--.

Column 8, Line 18, Change "asure" to --assure--.

Column 9, Line 12, Change "sprial" to --spiral--.

Column 9, Line 17, Change "correspoding" to --corresponding--.

Column 10, Line 19, Change "patent" to --patient--.

Column 11, Line 5, Change "patients" to --patient's--.

Column 12, Line 19, After "said" delete ",".

Signed and Sealed this

Seventeenth Day of January, 1989

*Attest:*

*Attesting Officer*

DONALD J. QUIGG

*Commissioner of Patents and Trademarks*